United States Patent [19]

Austin

[11] Patent Number: 4,879,013

[45] Date of Patent: Nov. 7, 1989

[54] METHOD OF CATIONIC ELECTRODEPOSITION USING DISSOLUTION RESISTANT ANODES

[75] Inventor: Henry T. Austin, Allison Park, Pa.

[73] Assignee: PPG Industries, Inc., Pittsburgh, Pa.

[21] Appl. No.: 220,416

[22] Filed: Jul. 19, 1988

Related U.S. Application Data

[63] Continuation of Ser. No. 835,148, Mar. 3, 1986, abandoned.

[51] Int. Cl.[4] ..... C25D 13/00; C25B 11/04

[52] U.S. Cl. ..... 204/180.2; 204/181.7; 204/299 EC; 204/290 R; 204/290 F

[58] Field of Search ..... 204/181.7, 180.2, 180.9, 204/299 EC, 300 EC, 290 R, 290 F

[56] References Cited

U.S. PATENT DOCUMENTS

| | | | |
|---|---|---|---|
| Re. 28,820 | 5/1976 | Beer | 427/126 |
| 3,773,555 | 11/1973 | Cotton et al. | 117/217 |
| 3,853,739 | 12/1974 | Kolb et al. | 204/290 F |
| 4,005,004 | 1/1977 | Seko et al. | 204/290 F |
| 4,033,847 | 7/1977 | Baker | 204/250 |
| 4,052,271 | 10/1977 | Beer | 204/181.1 |
| 4,294,677 | 10/1981 | Sakagami | 204/180.9 |
| 4,406,757 | 9/1983 | Huang | 204/58 |
| 4,415,905 | 11/1983 | Mitchell et al. | 346/1.1 |
| 4,473,453 | 9/1984 | Takahashi et al. | 204/290 R |
| 4,515,674 | 5/1985 | Takahashi | 204/292 |

FOREIGN PATENT DOCUMENTS

| | | | |
|---|---|---|---|
| 0088840 | 8/1978 | Japan | 204/181.7 |
| 855107 | 11/1960 | United Kingdom | 204/290 F |

OTHER PUBLICATIONS

Kirk-Othmer Encyclopedia of Chemical Technology, vol. 15, Third Edition, 1981, John Wiley & Sons, Inc., pp. 172-183, "Metal Anodes".

*Primary Examiner*—John F. Niebling
*Assistant Examiner*—Ben C. Hsing
*Attorney, Agent, or Firm*—William J. Uhl; Daniel J. Long

[57] ABSTRACT

Disclosed is cationic electrodeposition of an aqueous cationic resinous composition with an anode comprising a self-supporting substrate to which is adhered a coating of a conductive material selected from the group consisting of platinum, palladium, rhodium, ruthenium, osmium, iridium, gold, oxides thereof, and mixtures thereof. The anode is more resistant to dissolution than stainless steel anodes which are conventionally used in cationic electrodeposition.

4 Claims, No Drawings

METHOD OF CATIONIC ELECTRODEPOSITION USING DISSOLUTION RESISTANT ANODES

This application is a continuation of application Ser. No. 835,148, filed Mar. 3, 1986, now abandoned.

BACKGROUND OF THE INVENTION

1. Field of the Invention

The present invention relates to electrodeposition, and more particularly, relates to cationic electrodeposition of aqueous dispersions of cationic resinous compositions.

2. Brief Description of the Prior Art

Cationic electrodeposition has been used industrially since 1972. The early cationic electrodeposition compositions comprised quaternary ammonium salt group-containing resins in combination with aminoplast curing agents. In 1976, cationic compositions comprising amine salt group-containing resins in combination with blocked isocyanate curing agents were introduced for priming automobile bodies. Today, over 90 percent of the automobile bodies are primed by cationic electrodeposition and practically all of the cationic compositions use the amine salt-blocked isocyanate resins.

In cationic electrodeposition, the part being coated is of course the cathode. The counter-electrode or anode is usually made of a corrosion-resistant material such as stainless steel since most cationic electrodeposition baths are acidic in nature. Because of the electrochemical reactions which occur at the anode, the stainless steel electrode slowly dissolves during the cationic electrodeposition process. The rate of dissolution depends principally on the current density, temperature of the electrodeposition bath to which the anode is exposed; the greater the current density and the higher the temperature, the faster the rate of ion dissolution. Also, the composition to which the electrode is exposed can affect the rate of dissolution. The presence of chloride ion greatly accelerates dissolution, and other unknown constituents of the electrodeposition bath can also affect dissolution. It has been found, for example, that electrodeposition baths in one location may be relatively passive to the stainless steel anodes, whereas electrodeposition baths in another location employing the same cationic paint may be very aggressive towards the stainless steel anode. The dissolution of the anode results in low film builds and poor appearance. Eventually, if the dissolution is great enough, the anode must be replaced resulting in a time-consuming and expensive shut down of the electrodeposition process.

It is an object of the present invention to overcome the above problems and to provide for a method of cationic electrodeposition with an anode which is resistant to deterioration and dissolution in all cationic electrodeposition environments. Practicing cationic electrodeposition in this manner would insure consistent results in terms of coating quality and would also result in considerable savings from not having to replace the anodes because of dissolution.

SUMMARY OF THE INVENTION

In accordance with the present invention, a method of electrocoating an electrically conductive surface serving as a cathode in an electrical circuit comprising said cathode and an anode immersed in an aqueous dispersion of a cationic resinous composition is provided. The method comprises passing electric current between the cathode and the anode to cause a coating to deposit on the cathode. The anode consists of a substrate of a self-supporting material to which is adhered a coating of a conductive material selected from the group consisting of platinum, palladium, rhodium, ruthenium, osmium, iridium, gold, oxides thereof and mixtures thereof.

The electrode does not dissolve nor deteriorate in the cationic electrodeposition environment, provides for consistent quality coatings, and provides for considerable maintenance savings associated with not having to replace the dissolved stainless steel electrodes because of dissolution.

DETAILED DESCRIPTION

In the process of cationic electrodeposition, an aqueous electrodeposition bath containing an electrodepositable paint is placed in contact with an electrically conductive anode and an electrically conductive cathode and upon passage of an electric current, usually direct current, between the anode and cathode while immersed in the electrodeposition bath, an adherent film of paint is deposited on the cathode. The electrodeposition of the paint occurs at a constant voltage, typically between 50 and 500 volts, and at a current density of about 0.5 to 10 amperes per square foot, with higher current densities being used during the initial stages of the electrodeposition and the current density gradually decreasing as the deposited coating insulates the cathode.

Usually the cathode, such as a series of automobile bodies, are introduced into the electrodeposition bath or tank sequentially and continuously. The cathode passes through the bath where it passes a series of anodes arranged from the beginning to the end. The anodes first in line or towards the entrance end of the tank are subjected to the greatest current flows, and in the case of the stainless steel electrodes, dissolve the fastest. It is these anodes which are preferably replaced with the anodes of the present invention. Although all the stainless steel anodes may be replaced with the electrodes of the present invention, it may not be necessary to replace the stainless steel anodes which are positioned more towards the exit end of the tank since these electrodes may not have that great a current flow (due to the insulating effect of the deposited coating) and may not significantly dissolve in the bath. Therefore, the electrodes in the bath towards the entrance end of the tank should be those of the invention, whereas the other electrodes more towards the exit end of the tank may be of the conventional stainless steel type.

The anodes may be exposed directly to the electrodeposition paint or as is more usually the case, they may be part of an electrodialysis cell positioned within the electrodeposition bath, in which instance, the anodes are separated from the electrodeposition paint by semipermeable membranes which are permeable to ionic materials such as acid anion and water-soluble anionic impurities such as chloride ion but impermeable to resin and pigmant of the paint. The ionic materials which are attracted to the anode and pass through the membrane can then be removed from the bath by periodically flushing the anode area with water. In an electrodialysis cell, the anode area is commonly referred to as the anolyte cell and the liquid in which the anode is in contact the anolyte solution. Using the anodes in this manner is particularly desirable when the buildup of excess acid from the cationic electrodeposition resin is a particular problem.

The electrodeposition paints which are used in the process of electrodeposition comprise cationic resins, pigments, crosslinkers and adjuvant materials such as flow control agents, inhibitors, organic cosolvents and of course the dispersing medium, water. Specific examples of cationic electrodeposition compositions are those based on cationic resins which contain active hydrogens and include amine salt groups, for example, the acid-solubilized reaction products of epoxy resins and primary or secondary amines in combination with capped isocyanate curing agents. Cationic electrodeposition paints employing these resinous ingredients are described in U.S. Pat. No. 4,031,050 to Jerabek. Specially modified cationic resins such as those containing primary amine groups formed from reacting polyepoxides with diketimines containing at least one secondary amine group, for example, the methyl isobutyl diketimine of diethylene triamine, are also well known electrodeposition resins and cationic paints employing these resinous ingredients are described in U.S. Pat. No. 4,017,438 to Jerabek et al. Modified cationic resins such as those obtained by chain extending the polyepoxide to increase its molecular weight can also be used in the method of the invention. Such resins are described in U.S. Pat. No. 4,148,772 to Jerabek et al in which the polyepoxide is chain extended with a polyester polyol and in U.S. Pat. No. 4,468,307 to Wismer et al in which the polyepoxide is chain extended with a particular polyether polyol. Also, chain extension such as described in Canadian Patent 1,179,443 can be used.

The cationic electrodeposition paints preferably contain capped isocyanate curing agents because these curing agents provide for low temperature cure and the development of optimum cured coating properties. However, cationic electrodeposition paints based on epoxy resins and capped polyisocyanates are often contaminated with chloride ion which is a by-product of the method of preparation of the epoxy resins and capped polyisocyanates. Many epoxy resins are made from epichlorohydrin and certain polyisocyanates re made from phosgene. Chloride has a very adverse effect on the dissolution of the conventional stainless steel electrodes. It is therefore with cationic paints containing chloride ion that the invention is particularly useful. Such paints typically have a chloride ion concentration of at least 10, usually 10 to 200 parts per million (ppm) based on total weight of the aqueous dispersion.

The anodes which are useful in the process of the invention comprise a substrate of a self-supporting material which is chemically resistant and to which the coating of the specific metals and metal oxides described below will adhere. The substrate can be a metal but preferably is a valve metal. The term "valve metal" defines a metal which under anionic conditions oxidizes to form a chemically resistant oxide on the surface and is resistant to the passage of current. By chemically resistant is meant the substrate is resistant to the surrounding electrolyte, that is, the electrodeposition paint or the anolyte solution, and is not subject to an appreciable extent to erosion, deterioration or to electrolyte attack.

Examples of suitable valve metals include titanium, tantalum, niobium and alloys of these metals such as titanium with 1 to 15 percent by weight molybdenum. Because of its excellent corrosion resistance, cost, availability, and adhesion to the metal or metal oxide coating, titanium is the preferred valve metal.

It is not essential that the entire substrate be of the valve metal. Rather, a core of metal such as copper or aluminum may be cladded or coated with the valve metal.

To the self-supporting substrate is adhered a coating or a layer of a material which is electrically conductive and which functions as an anode in an electrical circuit. Also, the material should be chemically resistant under anionic conditions to the surrounding electrolyte. Examples of suitable materials are the metals platinum, palladium, rhodium, ruthenium, osmium, iridium, gold, and alloys of two or more of these metals. Also, oxides of these metals such as ruthenium oxide and iridium oxide and mixtures of two or more oxides can be used. Also, mixtures of metals and metal oxides can be used. Because of cost and Performance in an electrodeposition environment, ruthenium oxide and iridium oxide are preferred with ruthenium oxide being the most preferred.

The thickness of the substrate and the outer layer of the metal or metal oxide is not critical. It only is necessary that the thickness of the substrate furnish a self-supporting structure and the metal or metal oxide layer be present in an amount sufficient to function as an anode, that is, to b able to combine current density requirements with corrosion resistance.

Typically, the substrate is from about 50 to 500 mils in thickness and the metal or metal oxide layer is from 0.01 to 10 mils in thickness. The coating of the metal or metal oxide layer can be on both sides of the substrate or on one side, that is, the side facing the cathode. Preferably, the substrate is entirely covered with a metal or metal oxide layer.

The configurations of the anodes are not particularly critical but for use in electrodeposition tanks, they are usually square or rectangular. Typically, for use in industrial electrodeposition tanks, electrodes having an area of from about 10 to 50 square feet are used, and as mentioned above, usually a series of electrodes are positioned in the tank extending from the entrance to the exit end of the tank.

The procedure for making the electrodes is generally a proprietary process with the manufacturers. In general, the metal or metal oxide can be applied by evaporative techniques, thermal decomposition of suitable metal or metal oxides in organic medium, and by electroplating. In most of the application methods, a valve metal is first etched and then coated with the metal in the liquid phase. In the instance the oxide is desired, the oxide is precipitated by chemical, thermal or electrical means. Oxides of the group of metals can also be applied directly to the valve metal support in a molten bath of the oxide.

EXAMPLES

In the following examples, the corrosive effects of typical cationic electrodeposition paints towards a stainless steel anode and ruthenium oxide-coated titanium and iridium oxide-coated titanium anodes were evaluated. One cationic electrodeposition paint was based on an acid-solubilized epichlorohydrin-bisphenol A type epoxy resin-amine reaction product and a capped isocyanate curing agent. The epoxy resin was an epichlorohydrin-bisphenol A type. The paint was available from PPG Industries, Inc. under the trademark UNI-PRIME. The second paint was a cationic acrylic prepared from glycidyl methacrylate and contained a capped polyisocyanate curing agent. The paint was available from PPG as ED-4000. Samples of anolyte solutions from the paints were collected and used for testing. The anodes being tested were 6 inches by 1 inch and were made part of an electrical circuit inserted between two 6 inch by 1 inch steel cathodes. The electrode spacing was about 2 inches and the electrodes were immersed to a 2-inch depth in the anolyte solutions. The effects of temperature, amperage and time on the loss of weight of the electrodes was measured and is reported in Table I below.

TABLE I

Results of Anode Dissolution Testing

| Anode Material | Cationic Paint | Anolyte[1] Temperature (°F.) | Amps | Time in Hours | Weight Loss mils/year[2] |
|---|---|---|---|---|---|
| 316 stainless steel | UNI-PRIME | 100 | 0.5 | 4 | 104 |
| " | " | 120 | 0.5 | 4 | 128 |
| ruthenium oxide-coated titanium[3] | " | 100 | 0.5 | 8 | 0 |
| iridium oxide-coated titanium[4] | " | 150 | 0.5 | 5 | 0 |
| ruthenium oxide-coated titanium | " | 160 | 0.8 | 5 | 0 |
| 316 stainless steel | ED-4000 | 100 | 0.5 | 4 | 2100 |
| ruthenium oxide-coated titanium | " | 100 | 0.5 | 8 | 0 |
| " | " | 160 | 0.8 | 5 | 0 |
| iridium oxide-coated titanium | " | 150 | 0.5 | 5 | 0 |

[1]The anolyte solution for the UNI-PRIME cationic had a pH of 3.8, contained 0.03982 milliequivalents (MEQ) of acid per gram of anolyte, 0.0021 MEQ of base per gram and 0.0007 MEQ chloride per gram (24 ppm chloride ion). The anolyte solution for the ED-4000 had a pH of 2.8, contained 0.0583 MEQ acid per gram, 0.0018 MEQ base per gram and 0.0006 chloride per gram (21 ppm chloride).
[2]Determined according to ASTM D-A262.
[3]Available from Eltech Systems as EC-200.
[4]Available from Eltech Systems as TIR-2000.

I claim:

1. A method of electrocoating an electrically conductive surface serving as a cathode in an electrical circuit comprising said cathode and an anode immersed in an aqueous dispersion of a cationic resinous composition which will dissolve stainless steel anodes comprising passing electric current between said cathode and anode at a constant voltage of from 50 to 500 volts and at a current density of from 0.5 to 10 amperes per square foot to cause a coating to deposit on the cathode, characterized in that the anode does not dissolve nor deteriorate during the electrocoating process and comprises a titanium including alloys of titanium substrate to which is adhered a coating of a conductive material selected from the group consisting of ruthenium oxide, iridium oxide and mixtures of.

2. The method of claim 1 in which chloride ion is present in the aqueous dispersion in amounts of at least 10 parts per million based on weight of the aqueous dispersion.

3. The method of claim 1 in which the conductive material is ruthenium oxide.

4. A method of electrocoating an electrically conductive surface serving as a cathode in an electrical circuit comprising said cathode and an anode immersed in an aqueous dispersion of a cationic resinous composition containing from 10 to 200 parts per million chloride ion based on weight of the aqueous dispersion which will dissolve stainless steel anodes comprising passing electric current between said cathode and anode at a constant voltage of from 50 to 500 volts and at a current density of from 0.5 to 10 amperes per square foot to cause a coating to deposit on the cathode, characterized in that the anode does not dissolve nor deteriorate during the electrocoating process and comprises a titanium including alloys of titanium substrate to which is adhered a coating of a material selected from the group consisting of ruthenium oxide, iridium oxide and mixtures thereof.

* * * * *

UNITED STATES PATENT AND TRADEMARK OFFICE

CERTIFICATE OF CORRECTION

PATENT NO. : 4,879,013

DATED : November 7, 1989

INVENTOR(S) : Henry T. Austin

It is certified that error appears in the above-identified patent and that said Letters Patent is hereby corrected as shown below:

Column 6, line 2, "of" should be --thereof--.

Signed and Sealed this

Twenty-third Day of October, 1990

*Attest:*

HARRY F. MANBECK, JR.

*Attesting Officer*

*Commissioner of Patents and Trademarks*